US011735838B2

(12) United States Patent
Valentin et al.

(10) Patent No.: US 11,735,838 B2
(45) Date of Patent: Aug. 22, 2023

(54) TERMINAL WIRE CLAMP

(71) Applicant: Hubbell Incorporated, Shelton, CT (US)

(72) Inventors: William Ramon Valentin, Meriden, CT (US); Joseph Nicholas Cretella, Ansonia, CT (US)

(73) Assignee: Hubbell Incorporated, Shelton, CT (US)

( * ) Notice: Subject to any disclaimer, the term of this patent is extended or adjusted under 35 U.S.C. 154(b) by 267 days.

(21) Appl. No.: 17/113,483

(22) Filed: Dec. 7, 2020

(65) Prior Publication Data

US 2021/0091483 A1 Mar. 25, 2021

Related U.S. Application Data

(63) Continuation of application No. 16/692,625, filed on Nov. 22, 2019, now Pat. No. 10,862,225, which is a continuation of application No. 15/685,495, filed on Aug. 24, 2017, now Pat. No. 10,490,912.

(60) Provisional application No. 62/378,768, filed on Aug. 24, 2016.

(51) Int. Cl.

| | |
|---|---|
| ***H01R 4/42*** | (2006.01) |
| ***H01R 4/44*** | (2006.01) |
| ***H01R 9/24*** | (2006.01) |
| *H01R 24/78* | (2011.01) |

(52) U.S. Cl.

CPC ..... *H01R 4/42* (2013.01); *H01R 4/44* (2013.01); *H01R 9/24* (2013.01); *H01R 24/78* (2013.01)

(58) Field of Classification Search

CPC . H01R 24/78; H01R 4/42; H01R 4/44; H01R 9/24

See application file for complete search history.

(56) References Cited

U.S. PATENT DOCUMENTS

| | | | | |
|---|---|---|---|---|
| 4,040,700 | A * | 8/1977 | Obuch | H01R 4/34 439/431 |
| 4,099,826 | A * | 7/1978 | Mazzeo | H01R 9/00 439/389 |
| 4,174,148 | A | 11/1979 | Obuch | |
| 5,866,844 | A | 2/1999 | Osterbrock | |
| 6,109,937 | A * | 8/2000 | Bonilla | H01R 13/652 439/107 |
| 6,188,020 | B1 | 2/2001 | Osterbrock et al. | |

(Continued)

FOREIGN PATENT DOCUMENTS

| | | |
|---|---|---|
| CN | 101022065 | 8/2007 |
| CN | 201174364 | 12/2008 |

(Continued)

OTHER PUBLICATIONS

PCT/US2018/048388 International Search Report and Written Opinion dated Nov. 8, 2017.

(Continued)

*Primary Examiner* — Abdullah A Riyami
*Assistant Examiner* — Thang H Nguyen
(74) *Attorney, Agent, or Firm* — Robinson + Cole LLP

(57) ABSTRACT

A terminal wire clamp including a body, an aperture defined by the body, and a first tab. The body has a front face, a back face opposite to the front face, and a side edge. The first tab extends from the side edge in a first direction outside of a plane defined by the body.

20 Claims, 4 Drawing Sheets

(56) References Cited

U.S. PATENT DOCUMENTS

| | | | | |
|---|---|---|---|---|
| 6,206,737 | B1 * | 3/2001 | Bonilla | H01R 4/304 411/188 |
| 6,293,812 | B1 * | 9/2001 | Ewer | H01R 4/42 439/107 |
| 6,683,251 | B1 * | 1/2004 | Brant | H01R 4/363 174/53 |
| 6,743,029 | B1 * | 6/2004 | Greene | H01H 9/12 175/57 |
| 6,877,996 | B1 | 4/2005 | Franks, Jr. | |
| 7,175,485 | B1 | 2/2007 | Alderson et al. | |
| 9,543,667 | B2 * | 1/2017 | Kamor | H01R 4/34 |
| 10,141,662 | B2 * | 11/2018 | Bernard | H01R 4/36 |
| 2004/0089465 | A1 * | 5/2004 | Brant | H01R 4/363 174/53 |
| 2007/0076337 | A1 * | 4/2007 | Huang | H01H 83/04 361/42 |
| 2011/0104919 | A1 * | 5/2011 | Patel | H01R 13/70 439/620.22 |
| 2013/0122759 | A1 * | 5/2013 | Kamor | H01R 4/304 439/739 |
| 2015/0087191 | A1 * | 3/2015 | Laurent | H01R 13/447 439/782 |
| 2016/0173028 | A1 * | 6/2016 | Andrews | H02S 40/34 136/251 |

FOREIGN PATENT DOCUMENTS

| | | |
|---|---|---|
| CN | 102810772 | 12/2012 |
| CN | 102980149 | 3/2013 |
| CN | 203300815 | 11/2013 |

OTHER PUBLICATIONS

Chinese Patent Application No. 201780057099.0 First Office Action issued by the China National Intellectual Property Administration dated Mar. 25, 2020 and translation.

Office Action dated Oct. 10, 2022, by China National Intellectual Property Administration in corresponding Chinese Patent Application No. 20110409785.8 and an English translation of the Action. (14 pages).

* cited by examiner

TERMINAL WIRE CLAMP

RELATED APPLICATIONS

This application claims priority to U.S. patent application Ser. No. 16/692,625, filed Nov. 22, 2019, which claims priority to U.S. patent application Ser. No. 15/685,495, filed Aug. 24, 2017, which claims priority to U.S. Provisional Patent Application No. 62/378,768, filed Aug. 24, 2016, the entire contents of which are hereby incorporated by reference.

FIELD

Embodiments relate to a terminal wire claim for an electrical device.

SUMMARY

Electrical devices (for example, an electrical outlet or receptacle, a ground fault circuit interrupting (GFCI) device, an electric switch, etc.) are configured to connect to a power supply (for example, an alternating current (AC) power supply). Typically, the electrical devices are connected to the power supply via a line terminal wire, or conductor, and a load terminal wire, or conductor. The line and load conductors may be connected via a screw (for example, a terminal screw). Connecting the line and load conductors via a screw alone may result in a loose or improper connection.

Therefore, one embodiment provides a terminal wire clamp including a body, an aperture defined by the body, and a first tab. The body has a front face, a back face opposite to the front face, and a side edge. The first tab extends from the side edge in a first direction away from the front face.

Another provides an electrical device including a housing, a terminal, and a clamp. The terminal is configured to electrically connect to a conductor. The clamp is configured to electrically couple the conductor to the terminal. The clamp includes a body having a front face, a back face opposite of the front face, and a side edge. The clamp further includes a first tab extending from the side edge in a first direction away from the front face.

Yet another embodiment provides a method of manufacturing a terminal wire clamp. The method includes providing a body of the terminal wire clamp and cutting a first tab from a body of the terminal wire clamp. The method further includes bending the first tab away from a back face of the body and toward an opposite front face of the body so as to extend away from the front face in a first direction.

Other aspects of the application will become apparent by consideration of the detailed description and accompanying drawings.

DETAILED DESCRIPTION

Before any embodiments of the application are explained in detail, it is to be understood that the application is not limited in its application to the details of construction and the arrangement of components set forth in the following description or illustrated in the following drawings. The application is capable of other embodiments and of being practiced or of being carried out in various ways.

Figure 1:
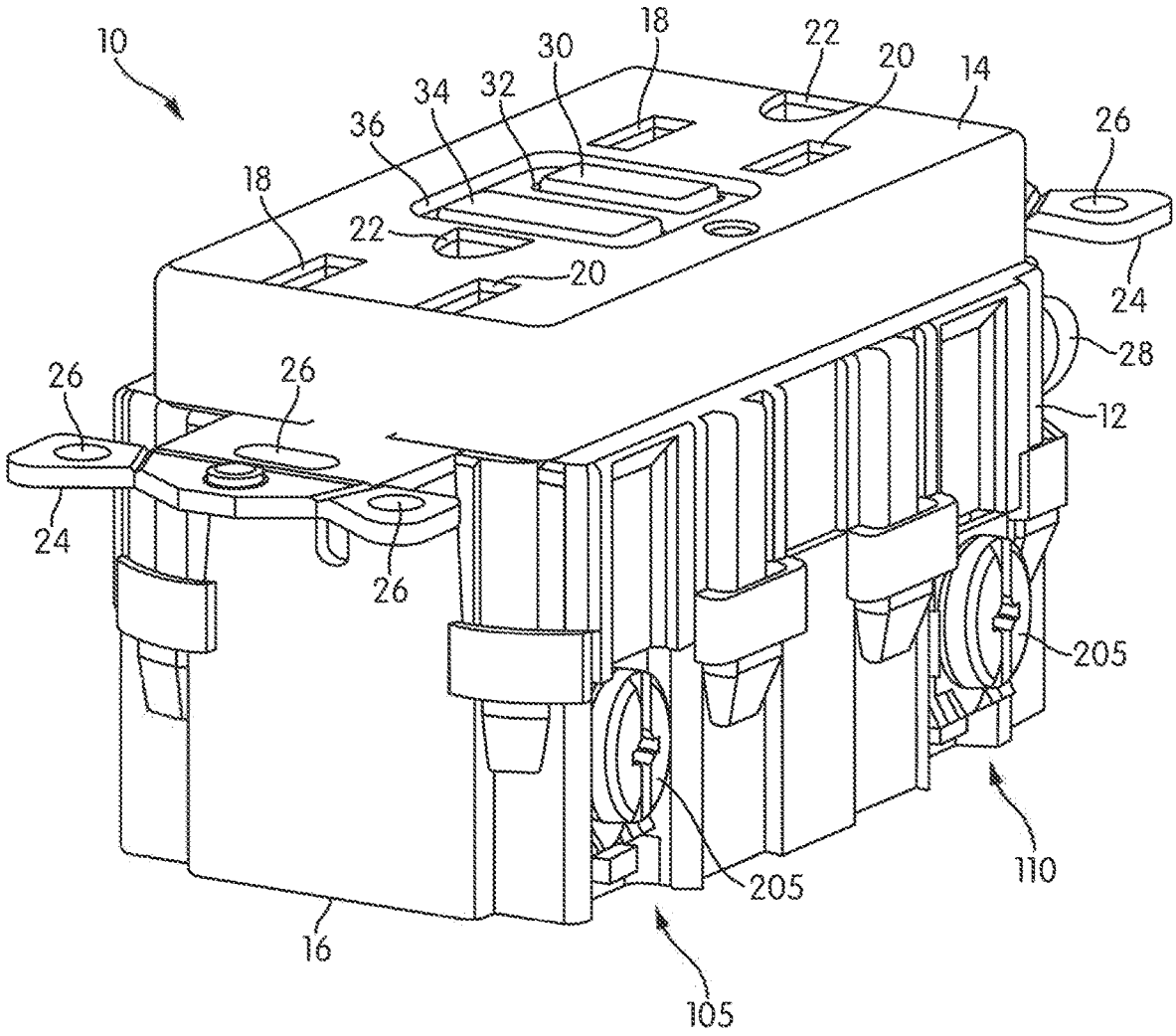
FIG. 1 is a top perspective view of an electrical device according to some embodiments of the application.

FIG. 1 is a perspective view of an electrical device 10 according to some embodiments of the application. In some embodiments, such as illustrated, the electrical device is an electrical outlet or receptacle. In such an embodiment, the electrical device 10 may be a ground fault circuit interrupting (GFCI) device. Although illustrated as an electrical outlet or receptacle, in other embodiments, the electrical device 10 may be an electrical switch, such as but not limited to a light switch.

The electrical device 10 includes a housing 12 having a cover portion 14 and a rear portion 16. The cover portion 14 and the rear portion 16 are removably secured to each other via fastening means such as clips, screws, brackets, tabs, and the link. The cover portion 14 includes face receptacles 18, 20 and grounding receptacles 22. The face receptacles 18, 20 and grounding receptacle 22 may be configured to accommodate polarized, non-polarized, grounded, or non-grounded blades of a male electrical plug. The male electrical plug may be a two-wire or three-wire plug without departing from the scope of the embodiment of the present application.

The electrical device 10 may further include one or more mounting straps 24 having mounting holes 26 for mounting the electrical device 10 to a junction box. Additionally, the electrical device 10 may further include a ground screw 28, located on the rear portion 16, for connecting a ground connector to the electrical device 10.

As illustrated, in some embodiments, the electrical device 10 may include a test button 30 and a reset button 34. The test button 30 extends through an opening 32 in the cover portion 14 of the housing 12, while the reset button extends through an opening 36 in the cover portion 14 of the housing 12.

The electrical device 10 further includes a line terminal 105 and a load terminal 110. The line terminal 105 is configured to electrically connect to a line conductor, or line wire. The load terminal 110 is configured to electrically connect to a load conductor, or load wire.

Figure 2:
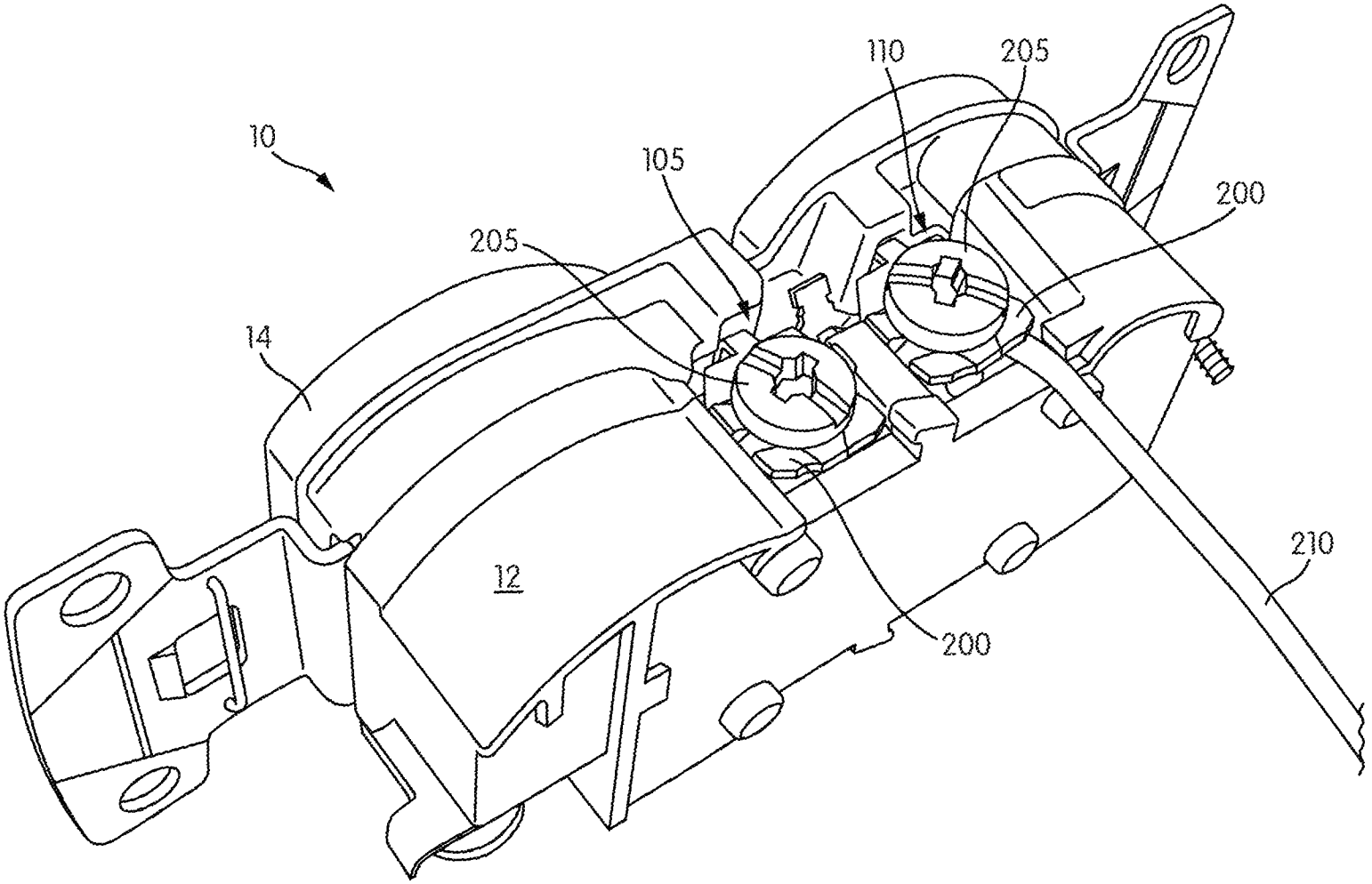
FIG. 2 is a side perspective view of the electrical device of FIG. 1 according to some embodiments of the application.

FIG. 2 illustrates a side view of the electrical device 10 according to some embodiments of the application. As illustrated, the line and load terminals 105, 110 each include a clamp, or terminal wire clamp, 200 and a screw, or terminal screw, 205. The terminal wire clamp 200, along with the terminal screw 205, are configured to secure a conductor 210 (for example, a line conductor or a load conductor) to the housing 12, in order to maintain an electrical connection between the conductors 210 and the respective line and load terminals 105, 110.

Figure 3B:
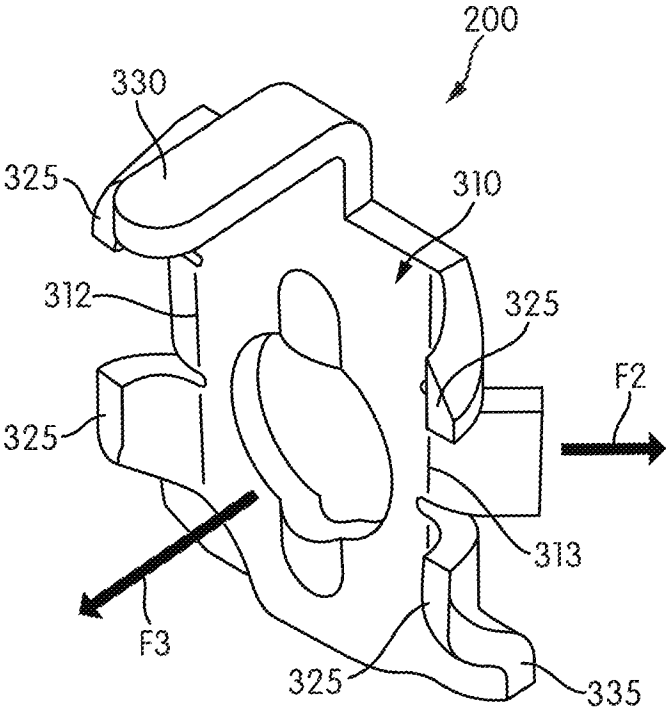
FIG. 3B is a rear perspective view of a clamp of the electrical device of FIG. 1 according to some embodiments of the application.
Figure 3A:
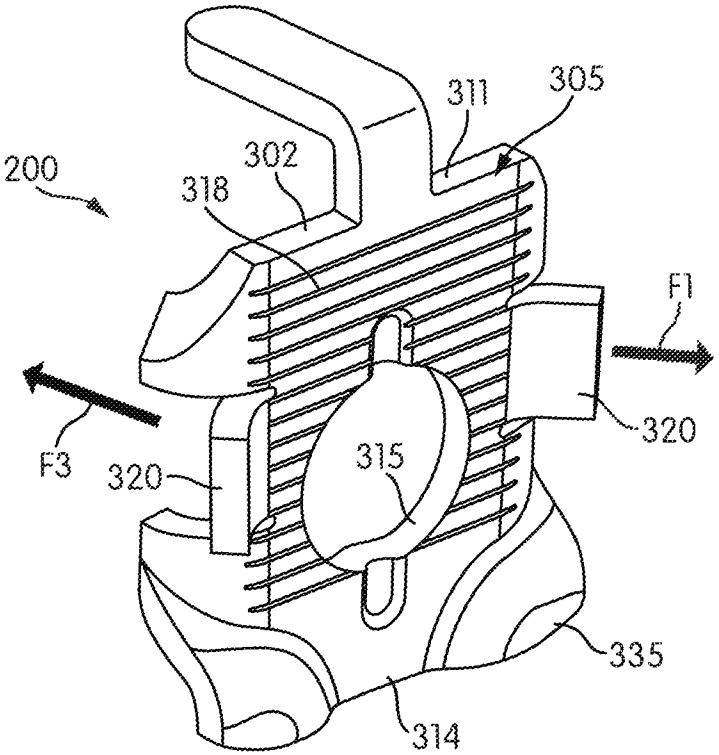
FIG. 3A is a front perspective view of a clamp of the electrical device of FIG. 1 according to some embodiments of the application.

FIGS. 3A and 3B illustrate a terminal wire clamp 200 according to some embodiments of the application. The terminal wire clamp 200 includes a generally planar body 302 having a front face 305, a back face 310, an upper edge 311, a first side edge 312, a second side edge 313, and a lower edge 314. The upper edge 311, the first side edge 312, the second side edge 313, and the lower edge 314 extend around a periphery of the front face 305 and the back face 310. In the illustrated embodiment, the upper edge 311 and the lower edge 314 are parallel, and the first and second side edges 312, 313 are parallel. In some embodiments, the front face 305 may include texturing 318, such as grooves or stippling. In other embodiments, the front face 305 may include other forms of texturing (for example, a knurled texture). Additionally, in some embodiments, the back face 310 may also include texturing.

The terminal wire clamp 200 further includes one or more side wire tabs 320, one or more back wire tabs 325, a hook 330, and raised lower corners 335. In the illustrated embodiment, the tabs 320, 325, the hook 330, and the raised corners 335 are integral to the body 302. The terminal wire clamp 200 also defines an aperture 315 extending through the body 302 from the front face 305 to the back face 310. In some embodiments, the aperture 315 is approximately centered on the front face 305 between the upper edge 311 and the lower edge 314, and the first and second side edges 312, 313. The aperture 315 is configured to receive the terminal screw 205 (as illustrated in FIG. 2) in order to promote coupling of the terminal wire clamp 200 to the housing 12 of the electrical device 10.

A first one of the side wire tabs 320 extends from the first side edge 312 of the body 302 in a first direction F1 extending away from the front face 305 of the terminal wire clamp 200. A second one of the side wire tabs 320 extends from the second side edge 313 of the body 302 in a second direction F2 extending away from the front face 305 of the terminal wire clamp 200. Each of the first and second directions F1, F2 forms an angle with the front face 305. In some embodiments, each angle is between about 15 degrees and about 90 degrees (for example, about 45 degrees). In other embodiments, the first and second directions F1, F2 are parallel and perpendicular to the front face 305. In some embodiments, each of the side wire tabs 320 is curved toward the first and second directions F1, F2, respectively. In other embodiments, each of the side wire tabs 320 is bent to project at a predetermined angle from the front face 305 in the first and second directions F1, F2, respectively.

The back wire tabs 325 extend from the first side edge 312 and/or the second side edge 313 of the body 302 in a third direction F3 extending away from the back face 310 of the terminal wire clamp 200, in which the third direction F3 is perpendicular to the back face 310. In some embodiments, the back wire tabs 325 are curved along at least a portion of the back wire tabs 325 toward the third direction F3. In other embodiments, each of the back wire tabs 325 is curved or bent at a predetermined angle to extend in the third direction F3. In yet another embodiment, the side wire tabs 320 may be bent in the third direction, while the back wire tabs 325 may be curved or bent in the first and second directions. In the illustrated embodiment, a back wire tab 325 is positioned on each side of a side wire tab 320 on each of the first and second side edges 312, 313.

The hook 330 extends from the body 302. In the illustrated embodiment, the hook 330 extends from the upper edge 311 of the body 302 in the third direction F3 away from the back face 310. However, in other embodiments, the hook 330 may extend from the first or second side edges 312, 313 or the lower edge 314, as well as in a direction opposite to the third direction F3. In the illustrated embodiment, the hook 330 is perpendicular to the back face 310. The hook 330 is configured to rotationally secure the terminal wire clamp 200, thereby inhibiting the terminal wire clamp 200 from rotating. In some embodiments, the hook 330 rotationally secures the terminal wire clamp 200 by contacting a portion (for example, the rear portion 16) of the housing 12 of the electrical device 10. In other embodiments, the hook 330 rotationally secures the terminal wire clamp 200 by inserting the hook 330 into an aperture (not shown) defined by the housing 12 of the electrical device 10.

The terminal raised corners 335 are out of plane with the body 302. The raised corners 335 are formed from the body 302 at an intersection of the first side edge 312 and the lower edge 314, and an intersection of the second side edge 313 and the lower edge 314. In the illustrated embodiment, the body 302 may define a first plane while the terminal raised corners 335 lie within a second plane. In such an embodiment, the first plane may be substantially parallel to the second plane.

During manufacture and fabrication of the terminal wire clamp 200, the terminal wire clamp 200 is formed from a flat or partially formed work piece (for example, a sheet). A periphery of the body 302 including the side wire tabs 320, the back wire tabs 325, and the hook 330 may be formed by a forming operation (e.g., stamping, punching, cutting, machining). The raised corners 335 may be formed during a forming operation (e.g., stamping). In addition, the aperture 315 may be formed during the same operation or a separate forming operation. Each of the side wire tabs 320 is bent away from the back face 310 and toward the front face 305 so that the side wire tabs 320 extend away from the front face 305 in the first and second directions F1, F2. Each of the back wire tabs 325 is also bent away from the front face 305 and toward the back face 310 so that each back wire tab 325 extends away from the back face 310 in the third direction F3. Similarly, the hook 330 is bent away from the front face 305 and toward the back face 310 so that the hook 330 extends away from the back face 310 generally in the third direction F3. Each of the side wire tabs 320, the back wire tabs 325, the hook 330, the raised corners 335, and the aperture 315 may be formed (e.g., via stamping, bending, cutting, machining) during a single operation or multiple operations in series. In addition, in some embodiments, a plurality of terminal wire clamps 200 may be cut out of and formed from a single work piece.

Figure 4B:
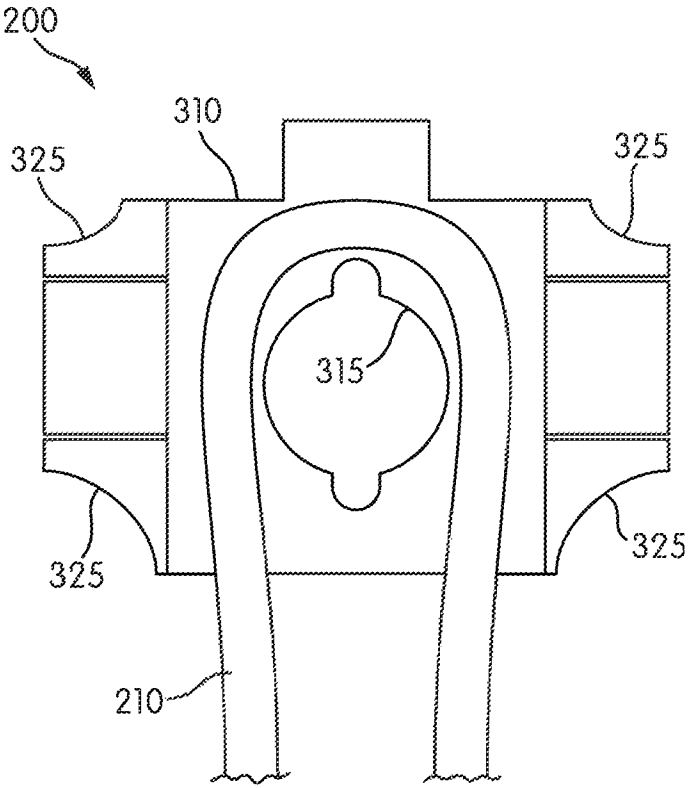
FIG. 4B is a rear view of a clamp of the electrical device of FIG. 1 according to some embodiments of the application.
Figure 4A:
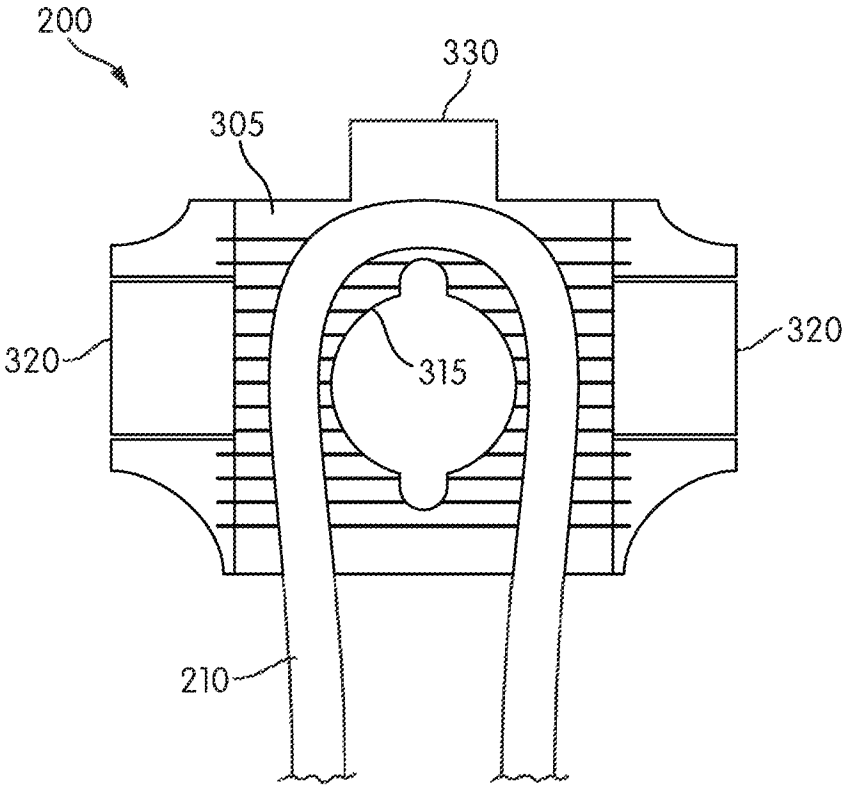
FIG. 4A is a front view of a clamp of the electrical device of FIG. 1 according to some embodiments of the application.

As illustrated in FIG. 4A, in some embodiments, a conductor 210 may be secured to the electrical device 10 between the front face 305 of the terminal wire clamp 200 and the terminal screw 205 inserted into the aperture 315, as well as between the side wire tabs 320. In such an embodiment, the side wire tabs 320 are configured to hold the conductor 210 in place on the front face 305 during installation and/or during torqueing of the terminal screw 205 within the aperture 315. The side wire tabs 320 may also assist with bundling stranded wire. Additionally, in some embodiments, the texturing of the front face 305 promotes securement of the conductor 210.

As illustrated in FIGS. 2 and 4B, in some embodiments, the conductor 210 may be secured to the electrical device 10 between a portion of the rear portion 16 of the housing 12 and the back face 310 of the terminal wire clamp 200. In such an embodiment, the back wire tabs 325 are configured to guide and hold the conductor 210 in place on the back face 310 during installation and/or during torqueing of the terminal screw 205 in the aperture 315. The raised corners provide a gap between the back face 310 of the terminal wire clamp 200 and the rear portion 16 of the housing 12 to provide additional space for inserting the conductor 210, as best illustrated in FIG. 2. The back wire tabs 325 may also guide the conductor 210 during installation when inserting the conductor 210. The back wire tabs 325 may assist with bundling stranded wire.

The conductor 210 may be positioned on either side of the terminal wire clamp 200 to connect a single conductor. Alternatively, a first conductor may be positioned between the front face 305 of the terminal wire clamp 200 and the terminal screw 205 while a second conductor may be concurrently positioned between the back face 310 of the terminal wire clamp 200 and the housing 12.

Thus, the application provides, among other things, a terminal wire clamp for use with an electrical device. Various features and advantages of the application are set forth in the following claims.

What is claimed is:

1. A terminal wire clamp comprising:

a body having a front face, a back face opposite to the front face, and a side edge, the body defining a plane;

a first tab extending from the side edge, the first tab extending out of the plane in a first direction;

a second tab extending from the side edge, the second tab extending transversely out of the plane in a second direction that is different than the first direction; and a third tab extending from the side edge such that a portion of the third tab extends in the first direction and another portion of the third tab extends in the second direction.

2. The terminal wire clamp of claim 1, further comprising an aperture defined by the body.

3. The terminal wire clamp of claim 1, wherein the first direction and the second direction extend from opposite sides of the plane.

4. The terminal wire clamp of claim 3, wherein the third tab is directly adjacent to the second tab along the side edge and wherein the second tab is directly adjacent to the first tab along the side edge.

5. The terminal wire clamp of claim 1, wherein a hook extends away from the back face beyond the first tab in the first direction, and wherein the first direction is perpendicular to the back face.

6. The terminal wire clamp of claim 1, further comprising texturing positioned on the front face of the body.

7. A terminal wire clamp comprising:

a body having a front face, a back face opposite to the front face, and a side edge, the body defining a plane;

a first tab extending from the side edge, the first tab extending out of the plane in a first direction;

a second tab extending from the side edge, the second tab extending out of the plane in a second direction that is different than the first direction; and a third tab extending from the body such that a portion of the third tab extends in the first direction and another portion of the third tab extends in the second direction, wherein the third tab includes a raised corner, and wherein the raised corner is disposed away from the body in the second direction and lies in a second plane substantially parallel to the plane.

8. An electrical device comprising:

a housing;

a terminal configured to electrically connect to a conductor; and a clamp configured to electrically couple the conductor to the terminal, the clamp including a body defining a plane and having a front face, a back face opposite of the front face, and a side edge, a first tab extending from the side edge and out of the plane in a first direction, a second tab directly adjacent to the first tab along the side edge and extending out of the plane in a second direction different than the first direction, and a third tab extending from the side edge, wherein a first portion of the third tab extends from the plane in the first direction and a second portion of the third tab extends from the plane in the second direction.

9. The electrical device of claim 8, wherein at least the back face, the first tab, a terminal screw positioned perpendicular to and passing through an aperture within the body, and the terminal define a space, the space configured to receive the conductor.

10. The electrical device of claim 8, further comprising a hook extending from the plane, wherein the hook is configured to be received in an aperture defined by the housing to inhibit rotation of the clamp.

11. The electrical device of claim 9, wherein the first direction and the second direction extend from opposite sides of the plane.

12. The electrical device of claim 10, wherein the hook extends away from the back face in the first direction and beyond the first tab, and wherein the first direction is perpendicular to the back face.

13. The electrical device of claim 8, further comprising texturing positioned on the front face.

14. The electrical device of claim 8, further comprising a terminal screw, and wherein the clamp further defines an aperture sized to receive the screw to couple the clamp and the conductor to the terminal.

15. A method of manufacturing a terminal wire clamp, the method comprising:

providing a body of the terminal wire clamp, the body defining a plane;

cutting a first tab from a side edge of the body;

bending the first tab outside of the plane in a first direction;

cutting a second tab from the side edge of the body, the second tab located directly adjacent to the first tab;

bending the second tab outside of the plane in a second direction that is different than the first direction;

cutting a third tab from the side edge of the body; and bending the bending the third tab such that a portion of the third tab extends in the first direction and another portion of the third tab extends in the second direction.

16. The method of claim 15, wherein the first direction and the second direction extend from opposite sides of the plane.

17. The method of claim 16, wherein the third tab is cut from the body at a location directly adjacent to the second tab.

18. The method of claim 15, further comprising cutting a hook from the body and bending the hook in the first direction such that, when the hook is bent in the first direction, the hook extends away from the body beyond the first tab in the first direction.

19. The method of claim 15, further comprising cutting a knurled texture into a face of the terminal wire clamp.

20. The method of claim 15, further comprising forming an aperture through the body.

* * * * *